US011148897B2

(12) United States Patent
Held

(10) Patent No.: US 11,148,897 B2
(45) Date of Patent: Oct. 19, 2021

(54) DEVICE AND METHOD FOR STORING VALUE DOCUMENTS, IN PARTICULAR BANKNOTES, AND STORAGE DEVICE AND VALUE DOCUMENT PROCESSING SYSTEM

(71) Applicant: GIESECKE+DEVRIENT CURRENCY TECHNOLOGY GMBH, Munich (DE)

(72) Inventor: Steffen Held, Munich (DE)

(73) Assignee: GIESECKE+DEVRIENT CURRENCY TECHNOLOGY GMBH, Munich (DE)

( * ) Notice: Subject to any disclaimer, the term of this patent is extended or adjusted under 35 U.S.C. 154(b) by 269 days.

(21) Appl. No.: 16/466,058

(22) PCT Filed: Nov. 28, 2017

(86) PCT No.: PCT/EP2017/001385

§ 371 (c)(1),
(2) Date: Jun. 3, 2019

(87) PCT Pub. No.: WO2018/099595

PCT Pub. Date: Jun. 7, 2018

(65) Prior Publication Data

US 2020/0035057 A1 Jan. 30, 2020

(30) Foreign Application Priority Data

Dec. 2, 2016 (DE) ..... 10 2016 014 367.3

(51) Int. Cl.
*B65H 29/00* (2006.01)
*G07D 11/13* (2019.01)
(Continued)

(52) U.S. Cl.
CPC ..... *B65H 29/006* (2013.01); *B65H 29/40* (2013.01); *B65H 29/6618* (2013.01);
(Continued)

(58) Field of Classification Search
CPC ..... B65H 29/006; B65H 29/40; B65H 2404/1114; B65H 2301/42194; B65H 2701/1912; G07D 11/13; G07D 2211/00
See application file for complete search history.

(56) References Cited

U.S. PATENT DOCUMENTS 4,903,908 A * 2/1990 Hansch ..... B65H 29/006 242/528
5,101,610 A * 4/1992 Honegger ..... B65H 29/006 53/430

(Continued)

FOREIGN PATENT DOCUMENTS

DE 19536481 A1 4/1997
DE 102009041669 A1 3/2011

(Continued)

OTHER PUBLICATIONS

German Search Report for PCT Application No. 102016014367.3, dated Jul. 21, 2017.

(Continued)

*Primary Examiner* — Jeremy R Severson
(74) *Attorney, Agent, or Firm* — Workman Nydegger

(57) ABSTRACT

An apparatus and a corresponding method involve storing value documents, in particular bank notes, to a storage device and to a value-document processing system. A stacker wheel is arranged to receive value documents and dispense them one after the other. A transport device is arranged to receive the value documents dispensed one after the other by the stacker wheel and to transport them in such a way that the value documents come to lie on top of each other in a shingled manner. A storage device for storing the value documents lying on top of each other in a shingled manner is provided.

20 Claims, 3 Drawing Sheets

(51) Int. Cl.
*B65H 29/40* (2006.01)
*B65H 29/66* (2006.01)

(52) U.S. Cl.
CPC .... *G07D 11/13* (2019.01); *B65H 2301/41924* (2013.01); *B65H 2301/4213* (2013.01); *B65H 2301/42194* (2013.01); *B65H 2301/44732* (2013.01); *B65H 2301/44765* (2013.01); *B65H 2404/1114* (2013.01); *B65H 2701/1912* (2013.01); *G07D 2211/00* (2013.01)

(56) References Cited

U.S. PATENT DOCUMENTS

| | | | | |
|---|---|---|---|---|
| 6,006,989 | A | 12/1999 | Ademmer et al. | |
| 6,889,970 | B2 * | 5/2005 | Takahashi | B65H 29/40 270/21.1 |
| 7,014,188 | B2 * | 3/2006 | Polidoro | B65H 29/006 271/216 |
| 2010/0303332 | A1 * | 12/2010 | Miki | G07D 11/50 382/135 |
| 2014/0001104 | A1 | 1/2014 | Petermann et al. | |

FOREIGN PATENT DOCUMENTS

| | | | |
|---|---|---|---|
| DE | 102011000797 | A1 | 8/2012 |
| EP | 0474999 | A1 | 3/1992 |
| EP | 1413539 | A2 | 4/2004 |

OTHER PUBLICATIONS

International Search Report and Written Opinion for PCT Application No. PCT/EP2017/001385, dated Mar. 2, 2018.

* cited by examiner

DEVICE AND METHOD FOR STORING VALUE DOCUMENTS, IN PARTICULAR BANKNOTES, AND STORAGE DEVICE AND VALUE DOCUMENT PROCESSING SYSTEM

BACKGROUND

This invention relates to an apparatus and a method for storing value documents, in particular bank notes, as well as to a storage device and to a value-document processing system.

With the automated processing of value documents, in particular of bank notes, it can be provided to store certain value documents temporarily in order to subsequently feed them to a further processing (so-called post-processing). This relates, for example, to value documents which are rejected during processing (so-called reject bank notes), e.g. because they have a lack of fitness or have been classified as a forgery.

For the temporary storage of value documents, from the prior art there are known apparatuses in which value document stacks are wound onto a spool core with the aid of a foil. The spool with the stored value document stacks is then fed to a verification device in which the value document stacks are unwound from the spool and the single value documents are post-processed and/or destroyed.

SUMMARY

It is an object of the present invention to improve the storage of value documents, in particular bank notes, and in particular to make it more efficient.

The apparatus for storing value documents, in particular bank notes, according to the invention, has a stacker wheel which is arranged to receive value documents and to dispense them one after the other, as well as a transport device which is arranged to receive the value documents dispensed one after the other by the stacker wheel and to transport them such that the value documents come to lie on top of each other in a shingled manner. The apparatus further comprises a storage device for storing the value documents lying on top of each other in a shingled manner.

The storage device for storing value documents, in particular bank notes, according to the invention, has: at least a first supply spool on which a first storage foil is wound, a storage spool and a feeding unit which is arranged to feed value documents to be stored, together with the first storage foil, to the storage spool in such a way that the value documents can be wound onto the storage spool.

The value-document processing system for processing, in particular for sorting, counting and/or checking value documents, in particular bank notes, according to the invention, has an apparatus for storing value documents according to the invention.

In the method for storing value documents, in particular bank notes, according to the invention, value documents are received by a stacker wheel, subsequently dispensed one after the other to a transport device and transported by means of the transport device in such a way that the value documents come to lie on top of each other in a shingled manner. The value documents lying on top of each other in a shingled manner are wound onto a storage spool with a first storage foil, in particular with the aid of a feeding unit.

One aspect of the invention is based on the approach of transporting the value documents to be stored, in particular bank notes, in the form of a shingle stream to the storage device and receiving the shingle stream in the storage device, in particular winding it onto a storage spool. For this purpose, the value documents are transported, in particular placed on top of each other and/or shifted against each other so that they come to lie or lie on top of each other in a shingled manner. Preferably, the edges of the value documents extending in the transport direction are essentially flush with each other, whereas the edges of the value documents extending perpendicular to the transport direction are offset from each other in the transport direction. For example, the offset of a value document relative to the value document respectively lying thereabove and/or therebelow is about 5-50 mm, preferably about 10-25 mm, in particular about 15 mm in the transport direction. A stack of about 100 value documents lying on top of each other is thus converted into a shingle stream having a length of about 0.5-5 m, depending on the offset.

This allows an efficient usage of the storage space in the storage device in which the value documents disposed in a shingled manner are wound up, since the storage winding arising from the winding up takes on a more regular, in particular round, shape than with a winding of value document stacks. In addition, the value documents disposed and stored in a shingled manner can be removed more easily from the storage device and fed singly to a further processing, as the leading edges of the stored value documents exit one after the other from the storage unit, so that the value documents are picked up singly, in particular automatically, and processed further.

Altogether, the invention thus allows an improved and more efficient storing of value documents, in particular bank notes.

In a preferred embodiment, the apparatus has a control device arranged to control the transport device and/or the stacker wheel such that the degree of overlap of the value documents coming to lie on top of each other is adjusted. This allows the length of the shingle stream and/or the thickness of the individual windings to be adjusted in targeted manner when winding up the shingle stream in the storage device, in order to enable a particularly efficient usage of the storage space and/or a simple and reliable removal of the stored value documents when unwinding the shingle stream.

In another preferred embodiment, the control device is arranged to adjust a transport speed at which the value documents are transported by the transport device and/or a dispensing rate at which the value documents are dispensed by the stacker wheel in such a way that a value document received by the transport device is transported by the transport device a specified distance before a subsequent value document is dispensed by the stacker wheel and comes to lie on the value document. Preferably, here, value documents are dispensed by the stacker wheel with a dispensing rate of about 20-60 value documents per second, preferably about 30-50 value documents per second, particularly preferably with about 40 value documents per second. Further preferably, value documents are transported by the transport device, in particular a transport belt and/or endless belt, at a transport speed of about 0.4-0.8 m/s, preferably at about 0.5-0.7 m/s, in particular at about 0.6 m/s.

The control device is preferably arranged to change the rotational speed of the stacker wheel and/or the transport speed of the transport device, in particular of the transport belt, relative to one another. This allows the degree of overlap between two value documents consecutively received and transported by the transport device to be adjusted particularly reliably.

In another preferred embodiment, the transport device is arranged to receive at least two value documents dispensed by the stacker wheel, which form a stack. The transport device here has a first transport element, in particular a transport belt, which abuts one side of the stack and moves at a first speed, in particular the transport speed. Further, a second transport element is provided which abuts a second side of the stack opposite the first side and moves at a second speed which is less than or equal to the first speed. This creates a speed gradient in the stack of value documents, in which the speed of the value documents decreases from the first side of the stack to the second side of the stack, so that the stack of value documents is shingled in a simple and efficient manner, in particular when transported to the storage device over a specified transport way.

In another preferred embodiment, the second transport element is configured as a paddle wheel with flexible transport paddles disposed regularly around an axis. Upon rotation of the paddle wheel, one or several of the transport paddles press onto the stack, so that a frictional connection with the topmost value document of the stack arises. The transport paddles moved at the second speed move more slowly than the transport belt, so that the stack's value documents lying on top of each other are shingled up reliably and over a short distance.

Alternatively, the second transport element is configured as a transport belt, in particular as an endless belt. This makes it possible to fan out value documents lying on top of each other, in particular stacked value documents, over a longer distance, in particular over a sinuously distance.

In another preferred embodiment, the transport device is arranged to receive at least two value documents dispensed by the stacker wheel, which form a stack, and to transport the stack along a curved transport way, one or several value documents of the stack following an inner course of the curved transport way travelling a shorter transport path than one or several value documents of the stack following an outer course of the curved transport way. Preferably, the curved transport way is at least partly specified by the first and/or the second transport element.

Alternatively or additionally, the value documents transported by the transport device, in particular one or several value documents on the first side of a stack or one or several value documents on the second side of a stack, are guided by an inner and an outer guide element along the curved transport way. Preferably, the inner and the outer guide elements respectively have a radius of curvature which substantially corresponds to a curvature of the first and the second transport element, respectively, in a region between the inner and outer guide elements.

By a curved transport way, in particular between a dispensing point of the stacker wheel and a feeding unit of the storage device, the shingling up of the value documents can be effected reliably and without great effort. With the aid of the first and the second transport element, in particular the transport belt, and/or the two opposite guide elements, the value documents disposed in a shingled manner, moreover, can be reliably inserted into the storage device.

In another preferred embodiment, the apparatus has a first supply spool on which a first storage foil is wound and a second supply spool on which a second storage foil is wound, as well as a storage spool. A feeding unit is arranged to feed the value documents lying on top of each other in a shingled manner, together with the first storage foil, to the storage spool such that the value documents lying on top of each other in a shingled fashion lie between the first storage foil. The apparatus further has a drive device arranged to set the storage spool into rotation so that the first storage foil fed to the storage spool is wound onto the storage spool together with the value documents.

The feeding unit preferably has for this purpose at least two deflection rollers, in particular disposed opposite each other, which are arranged to bring the first and second storage foils together, in particular to press them in such a way that the value documents lying on top of each other in shingled fashion are disposed, in particular fixed, between the first and the second storage foil, so that the first and the second storage foil with the value documents located therebetween can be wound onto the storage spool in a space-saving manner and without slipping out of position relative to each another. Thus, the stored value documents are also reliably present in the shingled arrangement when they are removed from the storage device.

The drive device is preferably also arranged to set the first and the second supply spool into rotation in order to convey the value documents disposed on top of each other in a shingled manner between the first and second storage foil out of the storage device.

The drive device may be part of the storage device itself. Alternatively, the storage device has attachment elements via which the drive device, which is not part of the storage device, can set the storage spool, the first and/or the second supply spool into rotation.

Altogether, by the arrangement of the value documents lying on top of each other in a shingled manner between the first and the second storage foil, a particularly quick and easy storing of value documents in the storage device and removing of value documents from the storage device is possible, as during these operations none of the storage foils must first be threaded or hung into a supply spool or unthreaded or unhung for transporting the storage device.

In another preferred embodiment, the storage device has a housing with an opening through which value documents can be fed to the storage spool for storage and/or stored value documents can be carried away from the storage spool, the feeding unit being disposed in the region of the opening such that value documents fed to the storage device dispose themselves between the first and second storage foil. Preferably, the housing is here configured to be cassette-like and can be inserted into a designated receiving device of the apparatus for storing value documents or of a post-processing apparatus. It is further preferred for the housing to have one or several handles with which the storage device can be transported.

Preferably, the value-document processing system comprises a verification apparatus arranged for a check of the value documents stored in the storage device and a receiving device arranged to receive the storage device and to feed the value documents stored in the storage device to the check in the verification apparatus.

Preferably, the receiving device is arranged to feed the value documents removed from the storage device to the post-processing apparatus in rotated and/or turned-over manner with respect to the alignment of the value documents in the shingle stream. The thus changed orientation of the value documents allows the value documents to be verified from a different perspective and can contribute to further increase the effectiveness of the verification.

BRIEF DESCRIPTION OF THE DRAWINGS

Further advantages, features and application possibilities of the present invention will result from the subsequent description in connection with the Figures. There are shown.

DETAILED DESCRIPTION OF VARIOUS EMBODIMENTS

Figure 1:
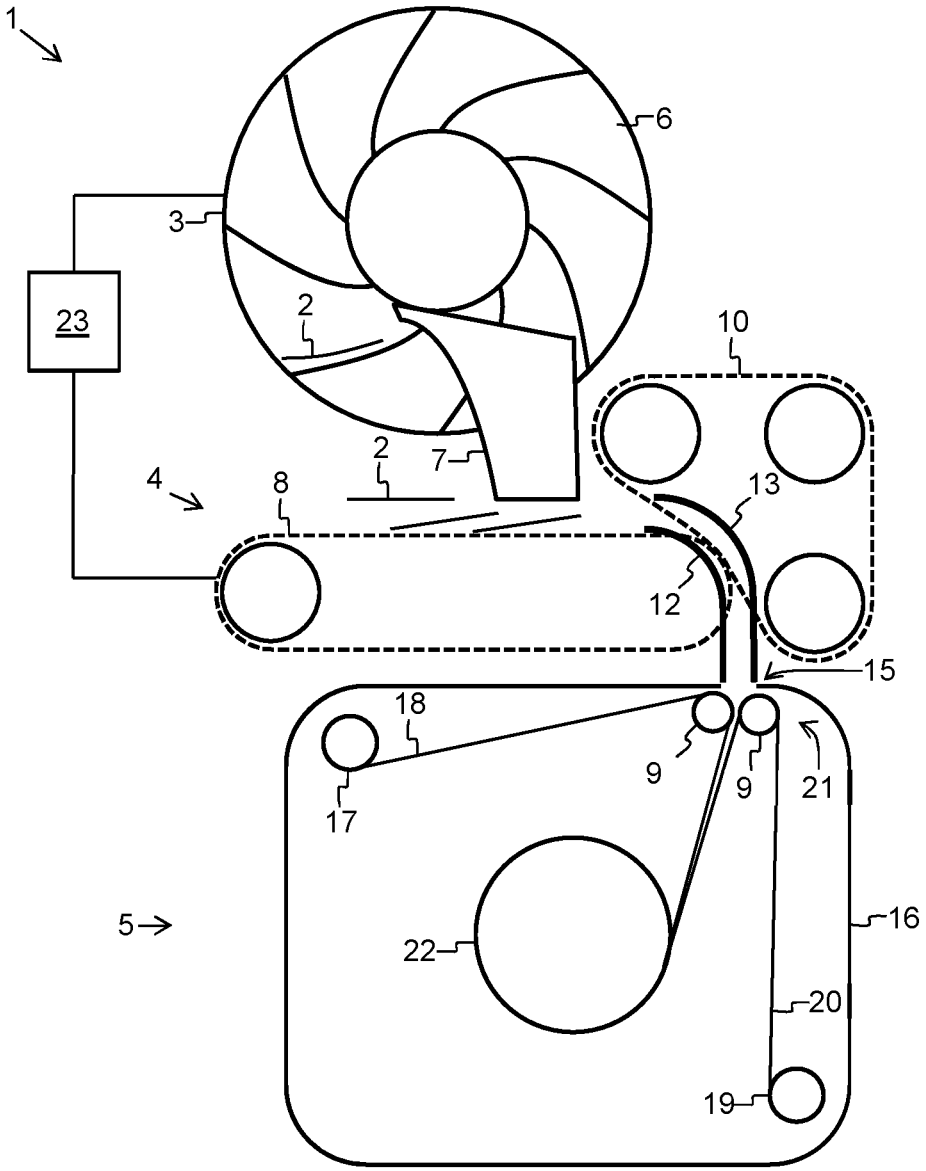
FIG. 1 a first embodiment example of an apparatus for storing value documents.

FIG. 1 shows a first embodiment example of an apparatus 1 for storing value documents 2, in particular bank notes, having a stacker wheel 3, a transport device 4, a storage device 5 and a control device 23 for controlling the stacker wheel 3 and the transport device 4.

The stacker wheel 3 has several stacker pockets 6 distributed over the circumference of the stacker wheel 3, which can receive value documents 2. By the rotation of the stacker wheel 3, the received value documents 2 are pressed out from the stacker pockets 6 by a stripper element 7 and dispensed to the transport device 4. In doing so, the stacker wheel 3 has a dispensing rate which depends on the stacker wheel's 3 rotation speed controlled by the control device 23.

The value documents 2 dispensed by the stacker wheel 3 are received by the transport device 4. The transport device 4 has a first transport element 8, for example a first transport belt, which is preferably driven by a drive unit (not shown). The control device 23 is preferably arranged to control the drive unit in such a way that the first transport element 8 transports value documents 2 at a first speed.

The dispensing rate of the stacker wheel 3 and a transport speed of the transport device 4, in particular the first speed of the first transport element 8, are mutually coordinated or controlled by the control unit 23 in such a way that the transport device 4 transports a received value document 2 a specified distance before the stacker wheel 3 dispenses a subsequent value document. Thus, a value document 2 subsequently dispensed by the stacker wheel 3 only partially covers the value document 2 received by the first transport element 8 and already transported further the specified distance, so that the two value documents lie on top of each other with a certain offset in the transport direction. This process is repeated for all further value documents received by the stacker wheel 3, thereby the value documents coming to lie on top of each other in a shingled manner and forming a shingle stream.

Occasionally, it may happen that a stacker pocket 6 of the stacker wheel 3 receives so-called multiple removals, i.e. a stack of two or more value documents 2 lying on top of each other substantially congruently, instead of a single value document 2, and dispenses them to the transport apparatus 4. In order to also shingle the value documents 2 of these multiple removals, the transport device 4 has a second transport element 10, which is preferably also configured as a transport belt and is arranged to transport value documents 2 at a second speed.

The second speed of the second transport element 10 is lower than the first speed of the first transport element 8, so that a value document 2 on a first side of the stack lying on the first transport element 8 is transported faster than a value document 2 on a second side of the stack opposite the first side, which is in frictional connection with the second transport element 10. Thus, a speed gradient is formed within the stack, the speed of the transported value documents 2 of the stack decreasing from the first side of the stack toward the second side of the stack.

When leaving the region between the first and the second transport element 8, 10, in which the value documents 2 have travelled a defined distance, the single value documents 2 of the stack thus come to lie offset, i.e. in a shingled manner, on top of each other.

Alternatively, the second speed of the second transport element 10 can be equal to the first speed of the first transport element 8. The longer path to be travelled at the outer pathway at the second transport element 10, compared with the shorter path to be travelled on the inner pathway at the first transport element 8, also results in a shingling.

Alternatively or additionally, an inner guide element 12 and an outer guide element 13 are disposed opposite each other. The inner and the outer guide element 12, 13 is arranged to guide value documents 2, which are transported by the first transport element 8 and/or the second transport element 10, along a specified, in particular curved, shorter inner or longer outer transport way to the storage device 5. This results in a shift between a value document 2 on the first side of the stack and a value document 2 disposed on the second side of the stack. Thus, also multiple removals are reliably shingled.

The value documents 2 lying on top of each other in a shingled manner, which leave the region between the first and the second transport element 8, 10 and/or the region between the inner and the outer guide element 12, 13, are fed to the storage device 5 through an opening 15 in the housing 16 of the storage device 5.

The storage device 5 has a first supply spool 19 and a second supply spool 17 in the interior of the housing 16, onto which a first storage foil 20 or a second storage foil 18 is wound or can be wound.

In the region of the opening 15 of the housing 16 a feeding unit 21 is arranged which has two deflection rollers 9, which deflect the first and the second storage foil 20, 18 in such a way that the incoming value documents 2 lying on top of each other in a shingled manner come to lie between the first and the second storage foil 20, 18 and, together with the first and the second storage foil 20, 18, are deflected in the direction of a storage spool 22.

The first and the second storage foil 20, 18 with the value documents 2 lying therebetween are wound onto the storage spool 22 upon a corresponding rotation of the storage spool 22 which is effected for example by a drive apparatus (not shown). The arrangement of the value documents 2 in a shingled manner between the first and the second storage foil 20, 18 results in a substantially uniform, in particular round, winding with stored value documents 2.

Preferably, the control device 23 is arranged to also control the drive apparatus which sets the storage spool 22 into rotation. This allows the transport of value documents 2 by means of the transport device 4 to be coordinated with the reception of the value documents 2 by the storage device 5.

Alternatively to the above-described storage device 5 with a first storage foil 20 and a second storage foil 18, a storage device with only one storage foil 20 can also be used. The value documents to be stored are then pressed directly against the storage spool 22 and wound up by means of the one storage foil 20.

Further alternatives to the configuration of the storage device 5 may provide that several adjoining storage foils are used. The adjoining storage foils can press—as described above—the value documents directly against the storage spool 22 and wind them onto it, or there is respectively provided a second storage foil in order to respectively wind the value documents between the first and the second storage foil of the adjoining storage foils, as described above.

Figure 2:
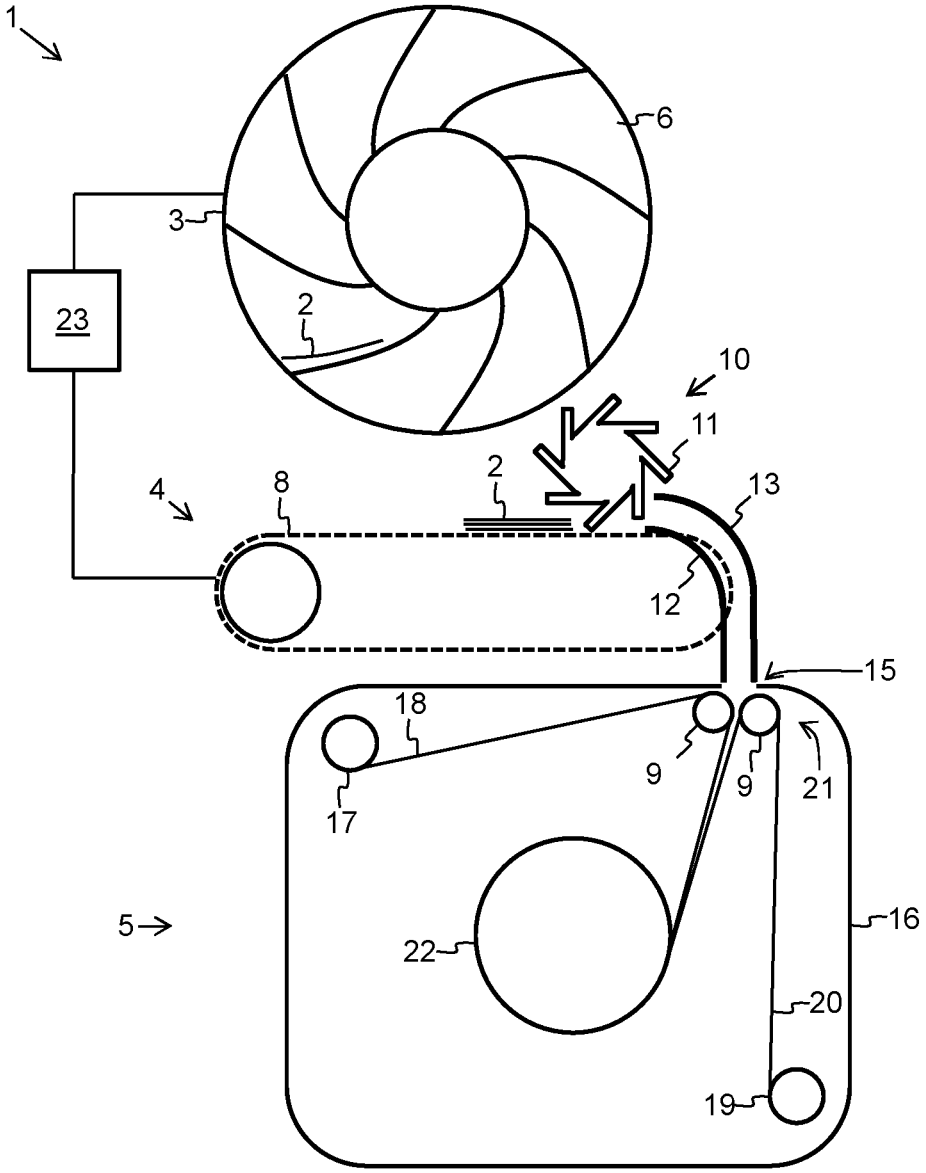
FIG. 2 a second embodiment example of an apparatus for storing value documents.

FIG. 2 shows a second embodiment example of an apparatus 1 for storing value documents 2, in particular bank notes, having a stacker wheel 3, a transport device 4, a storage device 5 and a control device 23 for controlling the stacker wheel 3 and the transport device 4. For reasons of clarity, the stripper element (see FIG. 1) of the stacker wheel 3 is not shown.

The transport device 4 here has a first and a second transport element 8, 10, the second transport element 10 being configured as a paddle wheel.

A stack of value documents 8 lying with a first side against the first transport element 8 is transported at a first speed by the first transport element 8. A value document 2 of a second side of the stack opposite the first side comes into contact with a flexible paddle 11 of the paddle wheel 10 which rotates at a second speed. This creates a speed gradient in the stack of value documents 2, the speed of value documents 2 of the stack decreasing from the first side of the stack toward the second side of the stack, so that the value documents 2 of the stack finally come to lie on top of each other in a shingled manner.

Otherwise, the above explanations for FIG. 1 apply accordingly to FIG. 2.

Figure 3:
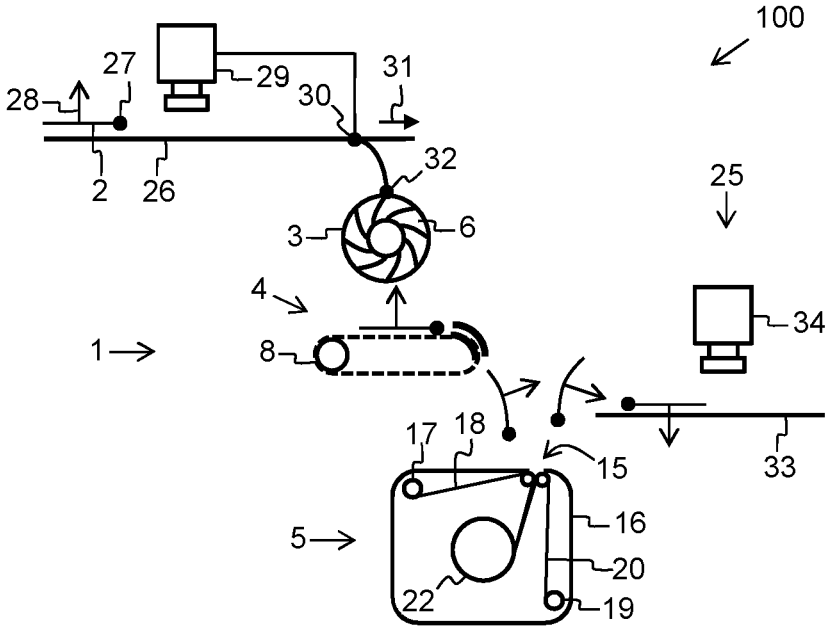
FIG. 3 an embodiment example of a value-document processing system.

FIG. 3 shows an embodiment example of a value-document processing system 100 for processing, in particular for counting, sorting and/or checking, value documents 2, having an apparatus 1 for storing value documents 2 and a post-processing apparatus 25 for post-processing, in particular checking, value documents 2, which is indicated only very schematically.

Value documents 2 to be processed are transported in a first orientation (see surface normal 28 and leading first edge 27) with the aid of a transport device 26 of the value-document processing system 100.

During the transport by the transport device 26, the value documents 2 pass a sensor apparatus 29 which captures the value documents 2 singly. On the basis of the sensor data generated by the sensor apparatus 29, the value documents are checked, for example with regard to authenticity and state (so-called fitness). Depending on the result of the check, the value documents are transported further and/or output via gates.

For example, a gate 30 can be controlled such that certain value documents 2, which upon the check are not recognised and/or classified as not authentic and/or unfit, are fed via the gate 30 to the apparatus 1 for storing value documents 2, whereas other value documents 2 pass the gate 30 in the direction indicated by arrow 31 and are fed to further processing and/or output.

A stacker wheel 3 of the apparatus 1 receives the corresponding value documents 2 at a receiving point 32 in the stacker pockets 6 and dispenses them to a transport device 4. The value documents 2 received by the transport device 4 still have the first orientation, as is apparent from the alignment of the edge 27 and the surface normal 28.

The value documents 2 come to lie on top of each other in a shingled manner in the transport device 4 and are fed to a storage device 5 in the form of a shingle stream. In this context, the above explanations regarding the FIGS. 1 and 2 apply accordingly.

Here, the leading edge 27 of the value documents 2 passes first through an opening 15 of a housing 16 of the storage device 5. The surface normal 8 of the value documents 2 disposed between a first and a second storage foil 20, 18 and wound on the storage spool 22 point radially outwards in the case shown. Alternatively, the alignment of the value documents 2 may also be changed, for example by disposing the opening 15 at a different place of the housing 16 of the storage device 5, such that in the stored state the surface normals 28 of the value documents 2 point radially inwards.

The portably configured storage device 5 together with the stored value documents 2 can be transported to the post-processing apparatus 25, which is preferably spatially separated from the apparatus 1, and can be connected there. By rotating the first and the second supply spools 17, 19, onto which the first and second storage foil 20, 18, respectively, are then wound, the value documents 2 lying between the two storage foils 20, 18 and wound on the storage spool 22 are unwound from the storage spool 22 and released.

Here, the second edge of the value documents 2 opposite the originally leading first edge 27 exits the opening 15 first. Furthermore, the exiting value documents 2 are reversed with respect to the original orientation, i.e. the surface normal 28 which was originally oriented upwards now faces downwards. While the sensor apparatus 29 in the example shown captures a first side (e.g. the front side) of the value documents, the sensor device 34 of the post-processing apparatus 25 can capture the second side (e.g. the back side) of the value documents 2 opposing the first side.

Figure 4A:
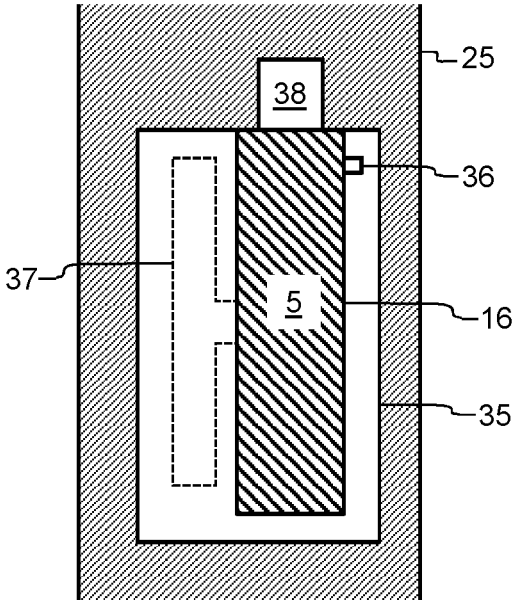
FIGS. 4A and 4B examples of a storage device received in a receiving device.
Figure 4B:
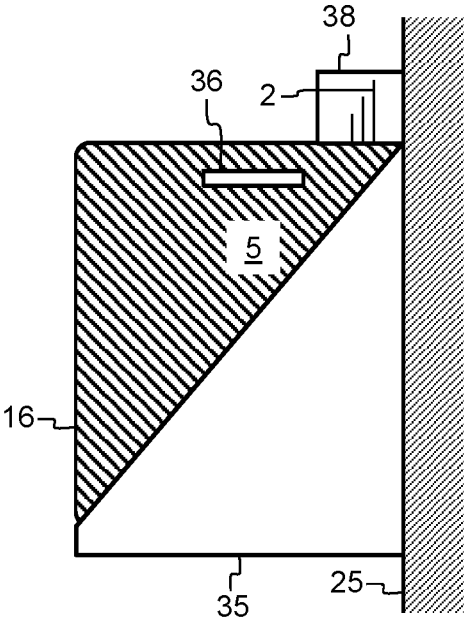

FIGS. 4A and 4B show a storage device 5 received in a receiving device 35 of the post-processing apparatus 25 in a very schematic front view (FIG. 4A) and side view (FIG. 4B).

The storage device 5 has a cassette-like housing 16 with a handle 36 with the help of which the storage device 5 can be easily transported and inserted into the receiving device 35.

The receiving device 35 has a drive apparatus 37 which is coupled to the storage spool and/or the supply spools (see FIGS. 1 to 3) of the storage device 5 when the cassette-like housing 16 is inserted. In this way, for the removal of the value documents stored in the storage device 5, the storage spool or the supply spools can be set into rotation by the drive apparatus 37.

The post-processing apparatus 25 further has a picking unit 38 arranged to singly pick up single value documents 2 protruding from an opening of the housing 16 of the storage unit 5 and to feed these to the post-processing apparatus 25 for further processing. The picking and further transporting of the single value documents is possible in a particularly simple and reliable way, since the value documents 2 in the storage unit 5 are stored lying on top of each other in a shingled manner and therefore exit from the opening of the housing 16 also in a shingled manner when the storage spool is unwound, as schematically indicated in FIG. 4B.

The invention claimed is:

1. An apparatus for storing value documents, in particular bank notes, comprising:

a stacker wheel which is arranged to receive and successively dispense value documents;

a transport device which is arranged to receive the value documents dispensed one after another by the stacker wheel and to transport the value documents in such a way that the value documents come to lie on top of each other in a shingled manner;

a storage device configured to store the value documents lying on top of each other in the shingled manner; and a control device, which is arranged to control the transport device and/or the stacker wheel in such a way that the degree of overlap of the value documents coming to lie on top of each another in the shingled manner is adjusted.

2. The apparatus according to claim 1, wherein the control device is arranged to adjust a transport speed at which the value documents are transported by the transport device and/or a dispensing rate at which the value documents are dispensed by the stacker wheel in such a way that a value document received by the transport device is transported by the transport device a specified distance before a subsequent value document is dispensed by the stacker wheel and comes to lie on the value document.

3. The apparatus according to claim 1, wherein the transport device is arranged to receive at least two value documents dispensed by the stacker wheel, which form a stack, and the transport device includes a first transport element which abuts one side of the stack and moves at a first speed, and a second transport element which abuts a second side of the stack opposite the first side and moves at a second speed which is less than or equal to the first speed.

4. The apparatus according to claim 1, wherein the transport device is arranged to receive at least two value documents dispensed by the stacker wheel, which form a stack, and to transport the stack along a curved transport way, wherein one or several value documents of the stack following an inner course of the curved transport way travel a shorter transport path than one or several value documents of the stack following an outer course of the curved transport way.

5. The apparatus according to claim 1, further comprising:

at least one first supply spool on which a first storage foil is wound;

a storage spool;

a feeding unit which is arranged to feed the value documents lying on top of each other in a shingled manner, together with the first storage foil, to the storage spool such that the value documents lying on top of each other in a shingled manner are guided in between the first storage foil and the storage spool; and a drive device which is arranged to set the storage spool into rotation so that the first storage foil fed to the storage spool is wound onto the storage spool together with the value documents.

6. The apparatus according to claim 5, further comprising a second supply spool on which a second storage foil is wound, wherein the feeding unit guides the value documents lying on top of each other in a shingled manner in between the first and the second storage foil, and the drive device sets the storage spool into rotation so that the first and the second storage foil fed to the storage spool are wound onto the storage spool together with the value documents lying between the first and the second storage foil.

7. The apparatus according to claim 1, wherein the storage device comprises at least one first supply spool on which a first storage foil is wound;

a storage spool; and a feeding unit which is arranged to feed value documents to be stored, together with the first storage foil, to the storage spool such that the first storage foil together with the value documents can be wound onto the storage spool.

8. The apparatus according to claim 7, wherein the storage device further comprises a housing, wherein the housing has an opening through which value documents can be fed to the storage spool for storage or stored value documents can be carried away from the storage spool, and wherein the feeding unit is disposed in the region of the opening such that value documents fed to the storage device dispose themselves between the first storage foil and the storage spool.

9. The apparatus according to claim 8, wherein the storage device further comprises a second supply spool on which a second storage foil is wound, wherein the feeding unit guides the value documents lying on top of each other in a shingled manner in between the first and the second storage foil, and a drive device sets the storage spool into rotation so that the first and the second storage foil fed to the storage spool are wound onto the storage spool together with the value documents lying between the first and the second storage foil.

10. A value-document processing system for processing value documents, the value-document processing system comprising an apparatus for storing value documents in accordance with claim 1.

11. The value-document processing system according to claim 10, further comprising a verification apparatus which is arranged for a check of value documents stored in the storage device and comprising a receiving device which is arranged to receive the storage device and to feed the value documents stored in the storage device to the check in the verification apparatus.

12. A method for storing value documents, the method comprising:

receiving value documents with a stacker wheel;

dispensing the value documents received by the stacker wheel one after the other to a transport device;

transporting the value documents dispensed one after the other by the stacker wheel to the transport device by means of the transport device in such a way that the value documents come to lie on top of each other in a shingled manner;

disposing the value documents lying on top of each other in a shingled manner between at least a first storage foil and a storage spool of a storage device;

controlling with a control device the transport device and/or the stacker wheel in such a way that the degree of overlap of the value documents coming to lie on top of each another in the shingled manner is adjusted; and winding up the value documents lying on top of each other in a shingled manner onto the storage spool by means of the first storage foil.

13. The method according to claim 12, further comprising adjusting a transport speed at which the value documents are transported by the transport device and/or a dispensing rate at which the value documents are dispensed by the stacker wheel in such a way that a value document received by the transport device is transported by the transport device a specified distance before a subsequent value document is dispensed by the stacker wheel and comes to lie on the value document.

14. The method according to claim 12, receiving by the transport device at least two value documents dispensed by the stacker wheel, which form a stack, and the transport device includes a first transport element which abuts one side of the stack and moves at a first speed, and a second transport element which abuts a second side of the stack opposite the first side and moves at a second speed which is less than or equal to the first speed.

15. The method according to claim 12, receiving by the transport device at least two value documents dispensed by the stacker wheel, which form a stack, and the transport devices transports the stack along a curved transport way, wherein one or several value documents of the stack following an inner course of the curved transport way travel a shorter transport path than one or several value documents of the stack following an outer course of the curved transport way.

16. The method according to claim 12, wherein the storage device comprises the at least one first supply spool on which the first storage foil is wound;

the storage spool;

and the method further comprises feeding by a feeding unit the value documents lying on top of each other in a shingled manner, together with the first storage foil, to the storage spool such that the value documents lying on top of each other in a shingled manner are guided in between the first storage foil and the storage spool; and setting the storage spool into rotation with a drive device such that the first storage foil fed to the storage spool is wound onto the storage spool together with the value documents.

17. The method according to claim 12, wherein the storage device comprises a second supply spool on which a second storage foil is wound, guiding by the feeding the value documents lying on top of each other in a shingled manner in between the first and the second storage foil, and the drive device sets the storage spool into rotation so that the first and the second storage foil fed to the storage spool are wound onto the storage spool together with the value documents lying between the first and the second storage foil.

18. The method according to claim 12, wherein the storage device comprises at least one first supply spool on which a first storage foil is wound;

a storage spool; and the method further comprises feeding by a feeding unit the value documents to be stored, together with the first storage foil, to the storage spool such that the first storage foil together with the value documents can be wound onto the storage spool.

19. The method according to claim 12, wherein the storage device further comprises a housing, and wherein the method further comprises feeding the value documents through an opening in the housing to the storage spool for storage or stored value documents can be carried away from the storage spool, and wherein the feeding unit is disposed in the region of the opening such that value documents fed to the storage device dispose themselves between the first storage foil and the storage spool.

20. The method according to claim 12, wherein the storage device further comprises a second supply spool on which a second storage foil is wound, wherein the feeding unit guides the value documents lying on top of each other in a shingled manner in between the first and the second storage foil, and a drive device sets the storage spool into rotation so that the first and the second storage foil fed to the storage spool are wound onto the storage spool together with the value documents lying between the first and the second storage foil.

* * * * *